US006484928B1

(12) United States Patent
Hoefte

(10) Patent No.: US 6,484,928 B1
(45) Date of Patent: Nov. 26, 2002

(54) TWO COMPARTMENT CARTON FOR GRANULAR MATERIALS

(75) Inventor: Paulus Antonius Augustinus Hoefte, St. Martens Latem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/646,077

(22) PCT Filed: Mar. 11, 1999

(86) PCT No.: PCT/US99/05312

§ 371 (c)(1),
(2), (4) Date: Sep. 13, 2000

(87) PCT Pub. No.: WO99/46171

PCT Pub. Date: Sep. 16, 1999

(30) Foreign Application Priority Data

Mar. 13, 1998 (EP) ..... 98870051

(51) Int. Cl.[7] ..... B65D 5/487; B65D 5/498

(52) U.S. Cl. ..... 229/120.21; 229/120.32; 229/226; 229/228

(58) Field of Search ..... 229/120.21, 120.03, 229/120.32, 120.38, 146, 226, 228; 206/273

(56) References Cited

U.S. PATENT DOCUMENTS

| | | | | |
|---|---|---|---|---|
| 2,017,176 A | * | 10/1935 | Andrews | 229/120.21 |
| 3,112,855 A | * | 12/1963 | Hennessey et al. | 229/120.32 |
| 3,735,916 A | * | 5/1973 | Buttery | 229/120.21 |
| 3,937,393 A | | 2/1976 | Nerenberg | |
| 4,274,578 A | * | 6/1981 | Montealegre | 229/120.32 |
| 4,416,377 A | * | 11/1983 | Swanberg | 229/120.21 |
| 5,092,516 A | | 3/1992 | Kastanek | |
| 5,445,314 A | * | 8/1995 | Newsome | 229/120.21 |
| 5,873,516 A | * | 2/1999 | Boggs | 229/120.32 |

FOREIGN PATENT DOCUMENTS

| | | |
|---|---|---|
| DE | 84 109 21 | 8/1984 |
| EP | 0 323 596 A1 | 7/1989 |
| EP | 0 575 694 A1 | 12/1993 |
| GB | 2 091 694 A | 1/1982 |

* cited by examiner

*Primary Examiner*—Gary E. Elkins
(74) *Attorney, Agent, or Firm*—Thibault Fayette; Kim William Zerby; Steven W. Miller

(57) ABSTRACT

The invention relates to a side fill carton used for example for granular materials comprising an extra panel (15) between the top (11) and the bottom (13) panels and thus forming a second compartment (8) in which a three dimensional object (7), such as a tool kit for example, can be placed while being isolated from the main compartment (9).

28 Claims, 9 Drawing Sheets

TWO COMPARTMENT CARTON FOR GRANULAR MATERIALS

TECHNICAL FIELD

The invention relates to carton board containers for granular materials and more particularly to such cartons which are side-fill cartons.

BACKGROUND OF THE INVENTION

Various types of containers are formed from carton board. Typical containers made from carton board, also simply called cartons, have a substantially parallelepipedal shape with six sides and twelve edges, namely the top, bottom, back, front, left and right sides, the edges being defined by the two sides of which they are the intersection, for example the edge between the top and the back sides. For definition purposes, it will be considered in the following that when the carton is upright the top and bottom sides are in the horizontal plane, the four other sides being vertical. We will consider that if the front side of the upright carton is facing an observer, the left side is on to the left of the observer and the right side on to the right of the observer, the back side being invisible for the observer.

Cartons are usually folded and glued from a die cut. A die cut, or blank, is a flat structure which has not been folded or glued. At least three main steps appear in the folding-gluing-filling process. In a first main step, the die cut is folded and glued to form a sleeve. A sleeve is substantially a four sided structure structured like a six sided carton of which two opposite sides are not folded or glued. In the sleeve structure, four of the twelve edges of the carton have been folded, these four edges being in a parallel direction to each other. It should be noted that usually the remaining eight edges all have their direction in a plane perpendicular to the direction of the four folded ones. The sleeve structure has the advantage that it can be flattened. As a consequence, sleeves can be stored or shipped easily. In a second main step, the carton is erected from the sleeve, which means that one of the two opposite sides which were not folded and glued during the sleeve step is now folded, four more edges being consequently formed. At this stage, the carton cannot be flattened anymore. However, it can be filled through the last non folded side. In the last step, the last non folded side is folded and glued, so forming the four last edges. In summary, when preparing a carton, the structure goes through successive stages, namely the die cut, followed by the sleeve, which subsequently is formed into an erected carton, before the closed carton stage. Each of these stages is separated by one main folding-gluing step.

There are two alternative ways of forming the sleeve from the die cut, because a choice can be made of the two opposite sides which will be left unfolded and unglued. In a first way, these two side may be the top and bottom sides. In a second way the right and left sides or the back and front sides will be left open. In theory, it is considered equivalent to choose back/front or left/right because these sides are differentiated only as a convention. However, the top/bottom sides are normally perpendicular to gravity when the carton is in its upright position.

In the first way of forming the sleeve, the sleeve will be formed of the front, left, back and right sides, or of any circular permutation of these, while the top and bottom sides will be left opened. In this case, the carton is usually erected by folding the bottom, and then by folding the top after filling. This way avoids having to turn the carton around after the filling process when the filling is made by means of gravity, because the carton is already upright when filled.

In the second way of forming the sleeve, the sleeve will be formed, for example, of the front, top, back and bottom sides, or of any circular permutation of these, while the left and right sides will be left opened. In this case, the carton is erected by folding indifferently the left or the right side, the left for example, the erected carton being filled through the right side, which should consequently be at the top of the carton during filling. Finally, the carton will be closed. After closing, the carton may have to be turned around in upright position, with the top side on the top.

As explained above, the eight edges which are not being folded to form the sleeve have their direction in a plane perpendicular to the direction of the four edges folded to form the sleeve. This means that in the die cut form, the four sleeve folded edges are in one direction and the eight others in the substantially perpendicular direction. By definition, the direction of the eight edges is called the main folding direction or axial direction because most of the folding is made along this direction. The other direction is the transverse direction. Normally, the four edges of the transverse direction should be the sleeve forming edges. As an example, in the first way for folding a sleeve, the front/left, left/back, back/right and right/front edges would be along the transverse direction, while in the second way of folding a sleeve, the front/top, top/back, back/bottom and bottom/front edges would be along the transverse direction.

A die cut is preferably made from a single piece. A die cut normally has a specific grain direction. This means that the material forming the die cut is not isotropic but has a preferred direction along which the die cut can be folded more easily. This direction is the grain direction. For easy folding, it is preferred that the main folding direction be in the grain direction.

For stiffness reasons, it is important that the grain direction is not horizontal, and preferably vertical, when the carton in its upright position. This means that the direction of gravity should be the grain direction for the front, back, left and right sides of the carton when the carton is upright, or that the edges front/left, left/back, back/right and right/front should follow the grain direction. Consequently, the edges front/left, left/back, back/right and right/front should not be in the transverse direction on the die cut. This leads to choosing the second way of folding for stiffness reasons. Cartons folded in such a manner are usually called side fill cartons. It should be noted that this denomination is due to the folding method, and is not directly linked to the grain direction. Examples of side fill cartons are disclosed in the pending applications JP-09066927 published on the 11th of March 1997, or JP-09278029-A published on the 38th of October 1997, or in applicant pending applications EP-97202128.1 filed on the 10th of July 1997 or EP-98200031.7 filed on the 8th of January 1998.

Side fill cartons disclosed in JP-09066927, EP-97202128.1 or EP-98200031.7 also include an extra panel together with a back flap associated with an edge to the extra panel as well as the usual top panel. Such a structure with an extra panel allows to form a lid with the top panel, which can be re-closed, while having a robust top side with a double panel and improving sift proofness, for example for granular materials.

The invention relates to a carton, the carton comprising top and bottom sides opposing each other, left and right sides opposing each other, and front and back sides opposing each other, whereby:

a) the front side comprises a first front flap;

b) the top side comprises a top panel associated with an edge to the first front flap;

c) the back side comprises a back panel associated with an edge to the top panel;

d) the bottom side comprises a bottom panel associated with an edge to the back panel;

e) the front side comprises a second front flap associated with an edge to the to the bottom panel;

f) the carton comprises an extra panel situated between the top and bottom panels, the extra panel being associated with an edge to the second front flap;

g) the back side comprises a back flap associated with an edge to the extra panel;

h) the left side comprises a first left flap associated with an edge to the first front flap, a second left flap associated with an edge to the back panel, a third left flap associated with an edge to the bottom panel and a fourth left flap associated with an edge to the second front flap;

i) the right side comprises a first right flap associated with an edge to the first front flap, a second right flap associated with an edge to the back panel, a third right flap associated with an edge to the bottom panel and a fourth right flap associated with an edge to the second front flap.

Such a carton is known from EP-97202128.1.

Among the advantage of such cartons is that they are side fill cartons having an extra panel, thus being relatively sift proof and having a robust structure.

While having these and other advantages, side fill cartons having such an inner top panel have disadvantages. For example, such cartons do not allow placing three dimensional objects such as a tool kit in a separated compartment, thus requiring users to dig into the content to gain access to such an object, or to erect this object from a two-dimensional structure, as in JP-09278029-A. In addition, when such cartons are filled, a handle may be required for facilitating transportation by the user.

Accordingly, it is an object of the present invention to produce a robust carton which is more satisfactory for the user.

SUMMARY OF THE INVENTION

In accordance with the invention, this object is accomplished in a carton of the above kind characterised in that j) the back panel comprises a folding line along a direction parallel to the plane of the top panel and situated between the extra and the top panels;

k) the second left and right flaps comprise a line of weakness situated between the extra and the top panels.

A carton formed in accordance with the invention has a number of advantages. Since the carton has a folding line in the back panel and since the second left and right flaps comprise a line of weakness, a second compartment is formed, the second compartment having as a top the top panel and as a bottom the extra panel, while the main compartment has its top formed from the extra panel and its bottom formed from the bottom panel. The access to the second compartment is provided by lifting together the top part of the carton composed of the top panel, the first front flap, the first and optional fifth left and right flaps as well as the part of the second0left and right flaps beyond the line of weakness and on the side of the top panel and the part of the back panel beyond the folding line and on the side of the top panel, the folding line thus acting as an hinge during the lifting of the top part of the carton. Indeed, once the top part of the carton is lifted in this manner, direct access is gained to the content of the second compartment. Access to the main compartment is for example obtained by tearing off part of the extra panel or the complete extra panel which forms both the floor of the second compartment and the roof of the other one. Additionally, the second compartment can be provided with openings allowing for example the insertion of fingers, thus forming a handle.

BRIEF DESCRIPTION OF THE DRAWINGS

The invention will now be described by way of example and with reference to the accompanying drawings in which.

DESCRIPTION OF THE PREFERRED EMBODIMENTS

Figure 2:
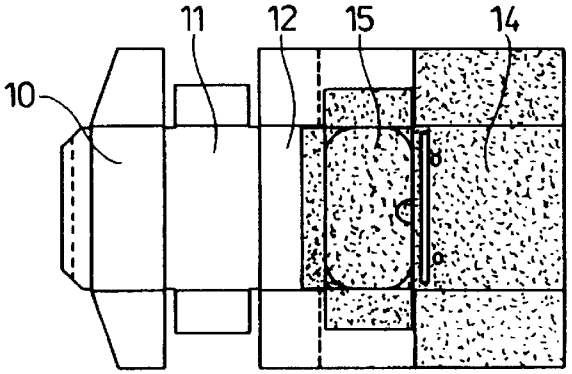
FIG. 2 is a top plan view of a partial sleeve made from the die-cut of FIG. 1.

The carton of the present invention is preferably made of cardboard or corrugated board, but other materials could also be used. Such cartons are usually used for housing granular materials. The cartons normally have a parallelepipedal shape with six sides. The sides can be defined as a top, bottom, left, right, back and front sides. The top side is on the top of the carton when the carton is in its upright position, the bottom side being opposite to the top side. For the purpose of the description, the front and back sides are opposing sides and the left and right side are opposite sides as well. Each of these sides can be made of several layers of material. Each of the sides is usually of a substantially rectangular shape, each side being limited at its borders by four edges. The structure of the carton is due to links which can exist between different layers of different sides through the edges. For example, if the front side is made of a single layer, this layer may be linked to the left side through the edge between the two sides, the link and the edge being provided by a folded line or/and by glue. The layers which compose the sides of the carton may be of different sorts. If such a layer is covering a complete side, it is called a panel, and is said as corresponding to the side it covers. When a layer covers a side only partially, it is called a flap, and it is said that it corresponds to the side it covers. However, a flap may be extended up to the panel size, in which case it is a long flap. Long flaps are particularly used for contributing to the rigidity of the structure. Flaps and panels can also comprise cut outs allowing use of a minimum amount of materials. Panels or flaps can be said as associated to another layer, which means that they have a side in common with this layer through a folded line, score line, line of weakness or by means of gluing, in doing so describing an edge of the carton. Each side may comprise one or more panels, one or more flaps, or a combination of these. In the present application, the panels may have in their denomination the name of the side of which they cover the surface, for example the bottom panel corresponds to the bottom side. In the present application the flaps may have in their denomination the name of the side with which they correspond once the carton is folded, followed of the name of the flap or panel with which they are associated. For example, the first left flap associated with an edge to the first front flap is forming part of the left side in the folded carton and is physically attached the front flap. It should be noted that the side denomination, namely left, right, top, bottom, back and front, are conventional denominations which are introduced for ease of explanation, and should not be limiting. Adhesive can be used for gluing flaps or panels to each other. For example, cold, water or solvent based glue can be used, applied with rollers or glue guns, but also hot melt glue, whether applied with glue guns or other glue applicators.

The carton structure of the present invention is such that the main compartment can be easily made sift proof, or even air tight if a special glue pattern is applied, so as to prevent air from passing through the structure, particularly if it comprises sixth left and right flaps associated to the extra panel with an edge along a folding line. The main compartment should preferably be sift proof both through the sides and through the edges. By sift proof, what is meant is that the content of the main compartment should not escape the carton in an undesired manner, for example in the form of dust or particles.

In order to be sift proof through the sides, and if the side comprises a panel, it has to be ensured that the panel does not accidentally burst. This is particularly important on the sides which usually are more exposed to external intervention which can lead to bursting. For this reason, the sides could comprise several comprises several layers, for example by using a die cut made of a flute between two liners, or simply by using a supplementary liner. If the side is composed of flaps, it is important that the flaps co-operate with each other as expected to obtain a sift proof structure. Usually, it is obtained by gluing the flaps to each other.

The structure should equally be sift proof along the edges. This is usually not difficult, except in the presence of a lid arrangement. Indeed, in the case of a normal carton, all edges could be made sift proof by applying a sufficient amount of glue. However, normal cartons should have a lid which can be lifted and re-closed without difficulty. This means that the lid should not be glued only with a limited amount of glue. This usually has the consequence that the carton is not completely sift proof around the lid area, or that spillage occurs at opening of the carton.

In the present invention, leakage can be prevented by using the extra panel, the sixth left and right flaps and the back flap to seal with glue the main compartment of the carton in the area of the extra panel. As a consequence, the content of the main compartment will be kept away from the area of the second compartment by the extra panel arrangement, so that the second compartment can be lightly glued to be lifted easily.

The carton may also comprise a snap lock mechanism in the lid area, of any kind known of the man skilled in the art, for example composed of a snap flap and of a snap tab. Preferred here are audible snap lock mechanisms. The second compartment may also be lifted at opening by means of a de-laminated area (not indicated on the drawings) combined with perforations or with extra glue spots. The carton may also comprise a tear strip for facilitating opening of the lid.

The carton of the present invention should allow use of a minimised amount of material for various reasons. Firstly, such a carton would not necessarily require a liner for extra stiffness if the grain direction is oriented adequately. Secondly, it is possible to use short flaps versions because skewing due to drag back is limited, so that the flaps are co-operating with each other as expected and do not need to be made larger to ensure that the carton is sift proof. Indeed, skewing is not critical for this type of carton because the optional sixth left and right flaps could make the carton sift-proof. Furthermore short flaps can be used because the link between the top panel and, for example, the left or right sides, is not critical, because the main compartment can be made sift proof even if the top panel is not tightly pressed onto the extremity of the flaps, were glue cannot be applied, so the main compartment can be made sift proof if sixth left and right flaps are providing the sealing. Additionally, the content of the main compartment can be increased at fixed cardboard quality because there is limited skewing, so that the structure is more robust and maintains better. This contributes to an additional object of the present invention for producing a carton with a reinforced structure and to yet another object of the invention which is to produce an ecological carton using a minimised quantity of materials.

Indeed, the extra panel is preferably part of a second part of the die cut for forming the carton, whereby it is a separated part of the die-cut. In such a case, the second element of the die cut may be comprising the extra panel as well as the back and third front flaps. The advantage of having such a separated second part for the die cut is that it can be made from a different material, including paper, plastic materials or films for forming a membrane, aluminium foil carton board, metallized film or a combination of these.

Furthermore, the second part of the die-cut preferably comprise sixth left and right flaps associated with the extra panel with an edge for example along a folding line. With such a structure, the second part of the die-cut allows to obtain a sift proof carton. Such a second part can have various shapes, examples of which are illustrated in EP-98200031.7.

In a general manner, the carton of the invention may comprise features and variations of the existing cartons, such as for example the cartons disclosed in EP 0 588 789 B1 or in WO 92/20583.

Usually, die cuts used for cartons are preferably made of one piece only. This often leads to difficulties for integrating the entire structure while ensuring that the final carton is sift proof and the carton easy to open. In the present invention, such difficulties can be solved while fulfilling another object of the present invention which is to produce a carton using a minimum amount of material. This can be achieved in the present invention as the extra panel together with the back and the optional third front flaps, as well as, optionally, the sixth left and right flaps, are normally a separated part of the die cut, so that it can be made from a different material. It should be mentioned that a die cut usually has a grain direction. The folding or cutting directions may be chosen so as to take account of the grain direction, considering that the cardboard is more foldable along the grain direction. Care should be taken while designing the die cuts that the grain direction is suitable, so that it ensures robustness and easy folding of the carton. For example, in the die cut of FIG. 1, the grain direction should be horizontal because it would allow easier folding of the left and right flaps and because the front and back side will participate more efficiently to supporting the structure if the grain direction of the panels of which they are composed is aligned with gravity. The die cut may be made of various materials including plain-board, corrugated board with or without moisture barrier or corrugated plastic.

Extra parts may be added, such as extra flaps. For example, snap lock means known of the man skilled in the art can be integrated to the die cut.

Figure 1:
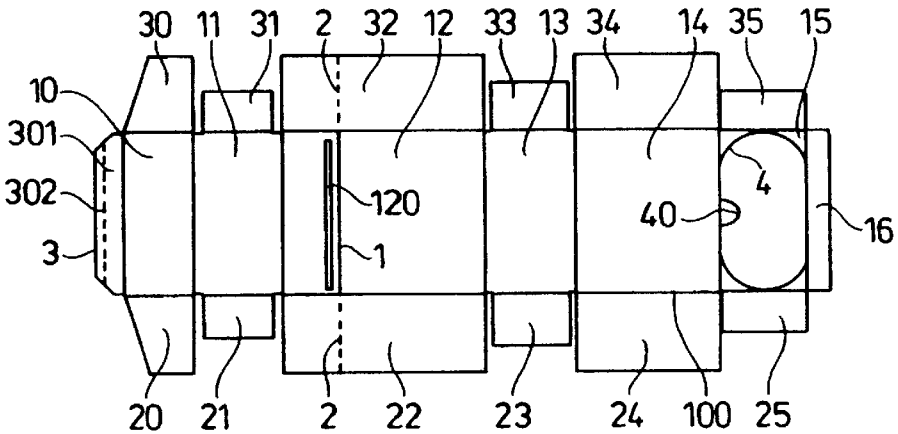
FIG. 1 is a top plan view of a preferred embodiment of a die cut for forming a carton according to the present invention.

FIG. 1 presents a die cut for a carton according to the invention. This die cut is a one piece die cut comprising in its central part the following: the back flap 16, the extra panel 15, the second front flap 14, the bottom panel 13, the back panel 12 with its folding line 1, the top panel 11, the first front flap 10, and the two optional flaps being a snap flap 301 and a flap tab 302 which form a snap lock 3 when the carton is re-closed. These are all following each other along a first direction 100, separated from each other by folding lines along a second direction perpendicular to the first direction 100. It should be noted that the back panel 12 in this example has a length along the first direction of the die-cut which substantially corresponds to the added lengths of the first 10 and second 14 front flaps. The added lengths of the first 10 and second 14 front flaps are slightly larger than the full length of the back panel 12 because it is preferred that the first front flap 10 covers at least partially the second front flap 14, thus facilitating reclosing of the carton. Indeed, in this embodiment, the folding line 1 of the back panel 12 is at the level or in the plane of the extra panel 15 when the carton is formed. In other words, when the carton is formed, the folding line 1 forming a hinge between the main 9 and the second 8 compartments is beside the edge between the extra panel 15 and the back flap 16 and follows this edge. However, this is optional, and this folding line 1 of the back panel 12 could also be at another level, this level being somewhere between the top 11 and the extra 15 panels when the carton is formed. On both sides of the central part, the die cut further comprises the left and right flaps, including the first 20, 30 second 22, 32 third 23, 33 and fourth 24, 34 left and right flaps, which are respectively linked by means folding lines along the first direction to the first front panel 10, the back panel 12, the bottom panel 13 and the second front flap 14. Furthermore, this die-cut comprises sixth left 25 and right 35 flaps linked to the extra panel 15 along the first direction 100 by means of folding lines, thus allowing to obtain a sift proof structure for the main compartment 9. It should also be noted that this die cut comprises a line of weakness 2 on the second left 22 and right 32 flaps which is aligned to the folding line 1 of the back panel 12, the line of weakness 2 thereby being at the level or in the plane of the extra panel 15. Such line of weakness 2 usually consists in a linear or curvilinear portion which has a voluntarily weakened structure, so that the material forming the carton will collapse preferably along this linear portion once a force is applied to this purpose. The intensity of the force needed depends on the material used and on the way the line of weakness is manufactured. Indeed, a line of weakness can be provided thanks to perforations, but it can also consist in a partial cut. In the die cut of FIG. 1, it should be noted that the extra panel 15 has the same dimension along the first direction 100 than the top 11 or the bottom 13 panels. This has as a consequence that when the carton is folded from the die cut, the extra panel 15 is in a plane parallel to the plane of the top panel 11 or of the bottom panel 13, as the back flap 16 is part of the back side. However, this is not a limitation, and the extra panel 15 may have a dimension larger than the dimension of the top 11 or bottom 13 panels along the first direction 100 so that when the carton is mounted, the extra panel 15 is inclined at an angle. It should also be noted that the die cut comprises fifth left 21 and right 31 flaps associated with an edge to the top panel 11. These fifth left 21 and right 31 flaps are not necessary to the structure but can be used for reinforcing it, or for making the second compartment 8 sift proof.

Figure 6:
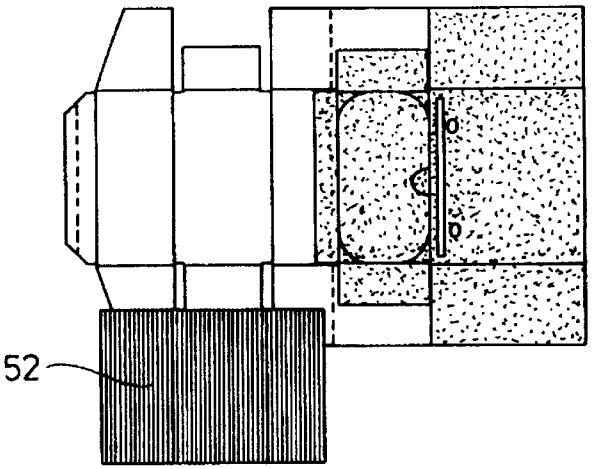
FIG. 6 is a top plan view of a second piece of liner and of a partial sleeve made from the die-cut with a first piece of liner of FIG. 5.

The die-cut of FIG. 1 is provided with glue 120 on the inner side of the back panel 12 in the part beside the folding line 1 for the hinge on the side of the top panel 11, in order to fold back and glue the back flap 16 as illustrated on FIG. 2. In this example, the back flap 16 is glued between the folding line 1 of the back panel 12 and the folding line between the back panel 12 and the top panel 11 because it is preferred to rigidify this portion. Indeed, in this manner the back flap 12 will tend to maintain the second compartment 8 opened because it will tend to stay aligned with the extra panel 15. This is particularly suited to this die-cut because it is provided with snap-lock 3 features, so that the carton can be maintained in the closed position even if the back flap 16 tends to open it. However, the back flap 16 could also be glued when folded back, thus not creating a constraint tending to open the carton, which would be most suitable for cartons which are not provided with a snap lock 3 feature. However, this would require folding back the back flap 16 prior to gluing as shown in EP-97202128.1, more particularly on FIGS. 1 and 6*b* of EP-97202128.1.

Figure 3:
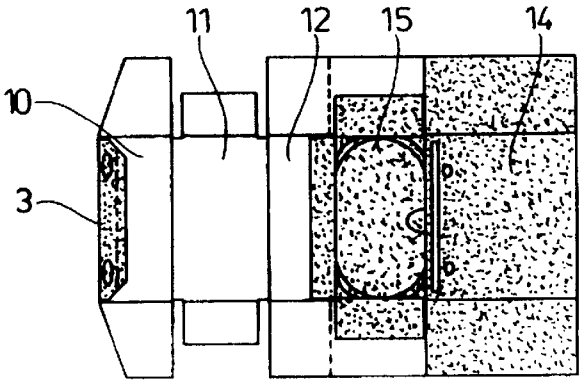
FIG. 3 is a top plan view of a partial sleeve made from the partial sleeve of FIG. 2.

The die-cut as illustrated on the partial sleeve of FIG. 2 can be further folded so as to shape the snap lock 3 as illustrated on FIG. 3, whereby the snap flap 301 and the snap tab 302 are folded back together.

Figure 4:
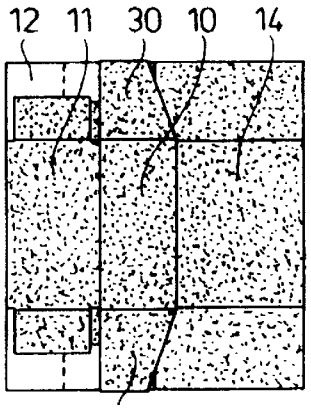
FIG. 4 is a top plan view of a sleeve made from the partial sleeve of FIG. 3.

Once this is done, the flaps forming the snap lock 3 can be glued onto the outside of the second front flap 14 as illustrated on FIG. 4, thus allowing to obtain a closed sleeve.

Forming of such a sleeve is normally made by the carton supplier. Once folded and glued, the sleeve can be shipped and delivered easily because it can be flattened. The erection takes place afterwards, usually directly on a production line.

Figure 8:
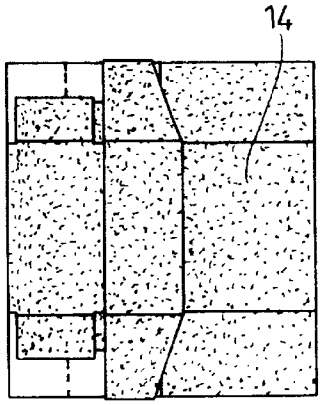
FIG. 8 is a top plan view of a sleeve made from the partial sleeve of FIG. 7.
Figure 5:
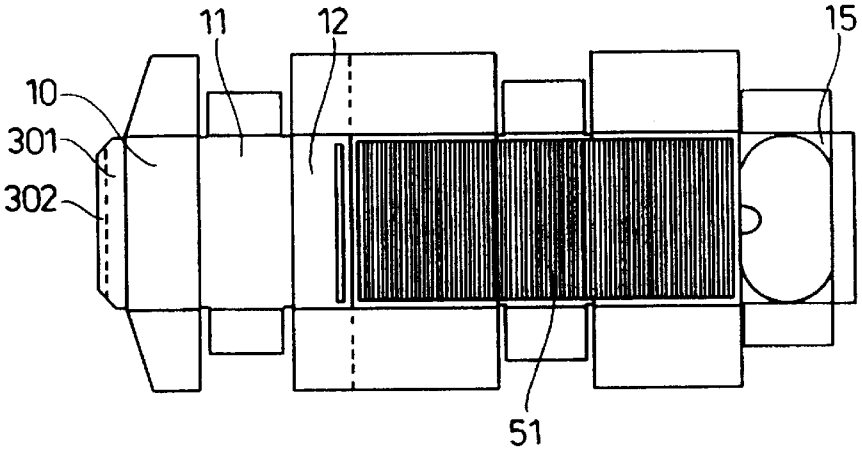
FIG. 5 is a top plan view of a preferred embodiment of elements of a die cut with a first piece of liner for forming a carton according to the present invention.
Figure 7:
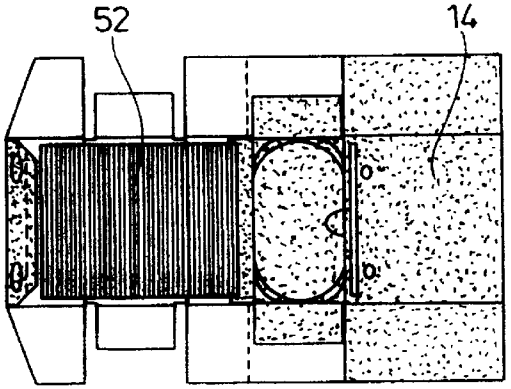
FIG. 7 is a top plan view of a partial sleeve made from the partial sleeve of FIG. 6.
Figure 10:
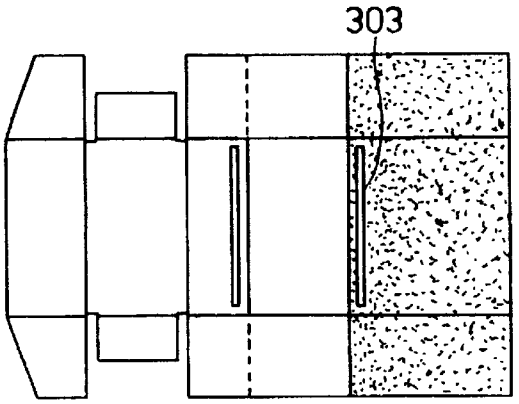
FIG. 10 is a top plan view of a partial sleeve made from the first piece of the die-cut of FIG. 9.
Figure 26:
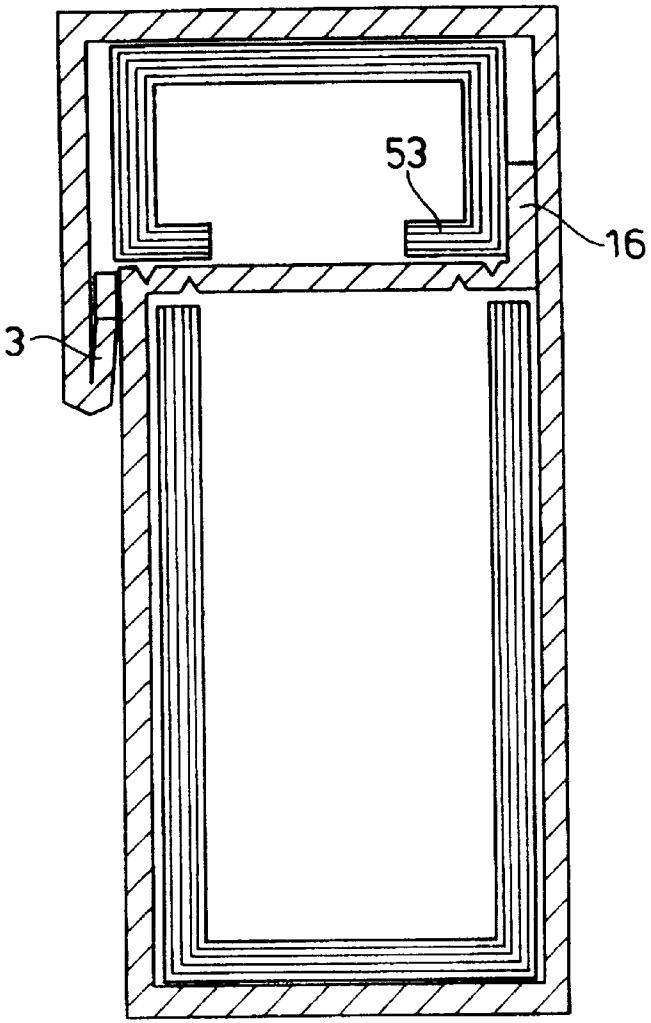
FIG. 26 is a cross-sectional view of a further embodiment of a carton according to the invention along a plane parallel to the left side showing the wall construction of the carton.

Another embodiment for forming a sleeve is illustrated in FIGS. 5 to 8. In this particular embodiment, the die cut is further provided with a two parts liner 51, 52 which allows to further reinforce the structure of the carton. This particular liner is made of two parts 51, 52, but a one part liner 5 could also be used. It is also possible to reinforce only the second compartment 8 or only the main compartment 9. Such reinforcement is particularly useful for cartons which have a bigger size, or which need to be stacked in large numbers. This mostly depends on the material used and on the size of the carton, the aim being to avoid deformation of the structure. Indeed, in a preferred embodiment, the carton according to the invention comprises an inner liner 5. In the example of FIG. 5, the liner 51 provided is covering the second front flap 14 as well as the bottom panel 14 and a part of the back panel 12 comprised between the folding line 1 of the back panel 12 and the bottom panel 14. Therefore, this particular part 51 of liner covers the main compartment 9. Another part of liner 52 is added in FIG. 6, covering the rest of the back panel 12, the top panel 11 and the first front flap 10 to reinforce the second compartment 8. It should be noted that this part 52 of the liner could be extended on the snap flap 301 (and or the snap tab 302) and on the extra panel 15, to be folded together with the snap flap 301 and the folding line 1, in order to obtain a further reinforced structure 53 as illustrated in FIG. 26. A sleeve can thereafter be formed as illustrated in FIG. 8.

Figure 13:
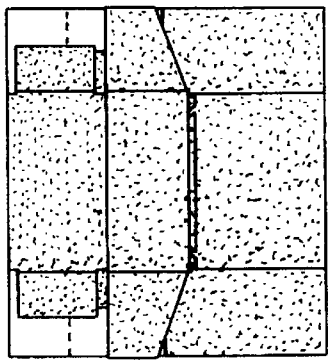
FIG. 13 is a top plan view of a sleeve made from the partial sleeve of FIG. 12.
Figure 9:
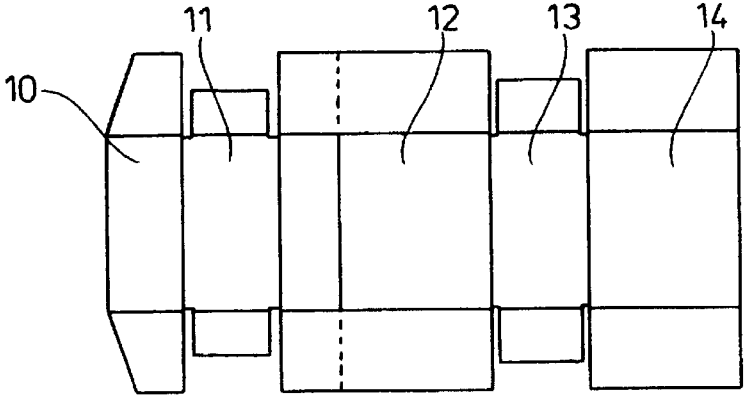
FIG. 9 is a top plan view of a preferred embodiment of a first piece of a die cut for forming a carton according to the present invention.
Figure 11:
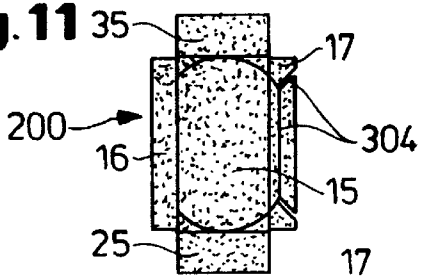
FIG. 11 is a top plan view of a second piece of a die cut for forming a carton according to the present invention.
Figure 12:
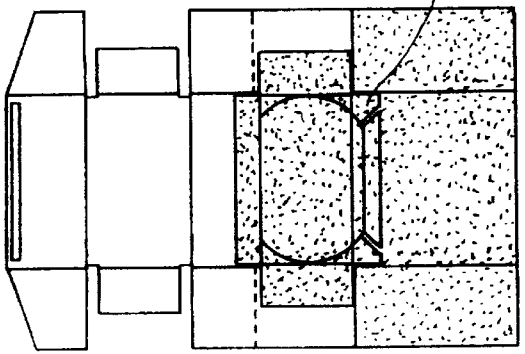
FIG. 12 is a top plan view of a partial sleeve made from the assembly of first and the second pieces of the die-cut according to FIGS. 10 and 11.

A further embodiment of a die-cut for forming a carton according to the invention is presented on FIGS. 9 to 13. In this particular embodiment, the die cut is formed from two separated pieces, one illustrated in FIG. 9, the other 200 in FIG. 11. A particular snap lock mechanism is illustrated here, whereby the second part 200 of the die-cut comprises an optional third front flap 17 as well as the extra panel 15, the back flap 16 and the optional sixth left 25 and right 35 flaps. Indeed, this third front flap 17 can be provided with one or more lines of weakness 304 which correspond to one or more lines of weakness 303 onto the second front flap 14, as illustrated on FIG. 10, whereby these corresponding lines of weakness 303, 304 can be glued the one onto the other as illustrated on FIG. 12. Indeed, such a mechanism is such that at opening the lines of weakness will break when the second front flap 14 will be separated from the third front flap 17, so that part of the second front flap 14 will remain on the third front flap 17 and part of the third front flap 17 will remain on the second front flap 14, in such a manner that upon re-closure, the former lines of weakness will interconnect to produce a snap lock. The sleeve corresponding to this embodiment is illustrated in FIG. 13.

Figure 15:
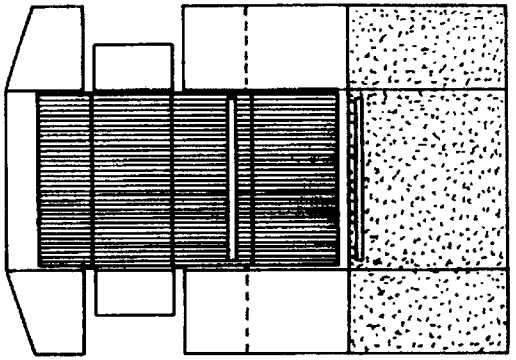
FIG. 15 is a top plan view of a partial sleeve made from the first piece of the die-cut of FIG. 14.
Figure 17:
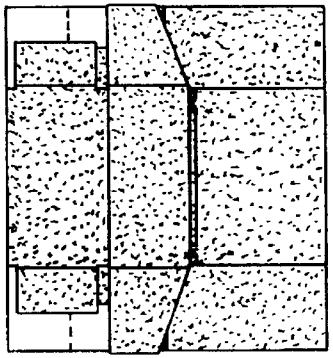
FIG. 17 is a top plan view of a sleeve made from the partial sleeve of FIG. 16.
Figure 14:
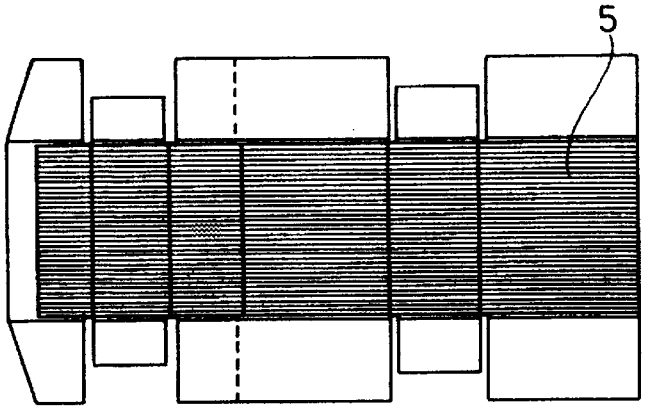
FIG. 14 is a top plan view of a preferred embodiment of a first piece of a die cut for forming a carton according to the present invention with a liner.
Figure 16:
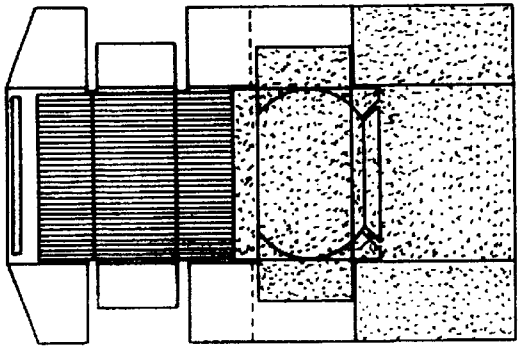
FIG. 16 is a top plan view of a partial sleeve made from the assembly of first and the second pieces of the die-cut according to FIGS. 15 and 11.
Figure 19:
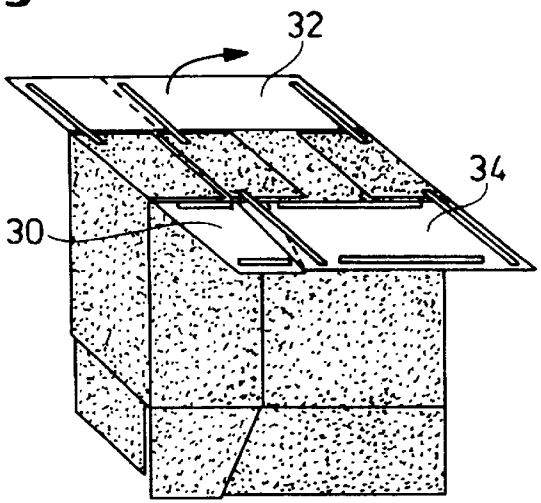
FIGS. 18 to 21 describe an example of the erecting step of a carton according to the present invention with a sequence starting from the complete sleeve of either of FIGS. 4, 8, 13 or 17.
Figure 21:
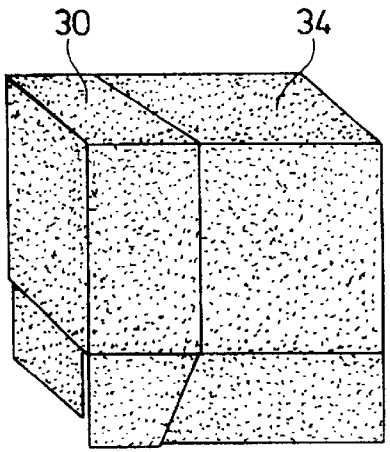
Figure 18:
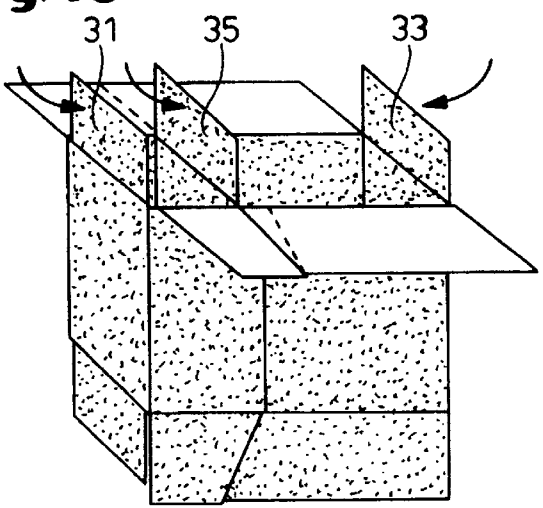
Figure 20:
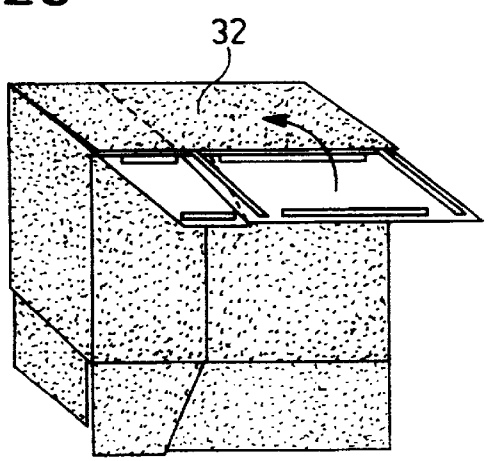
Figure 24:
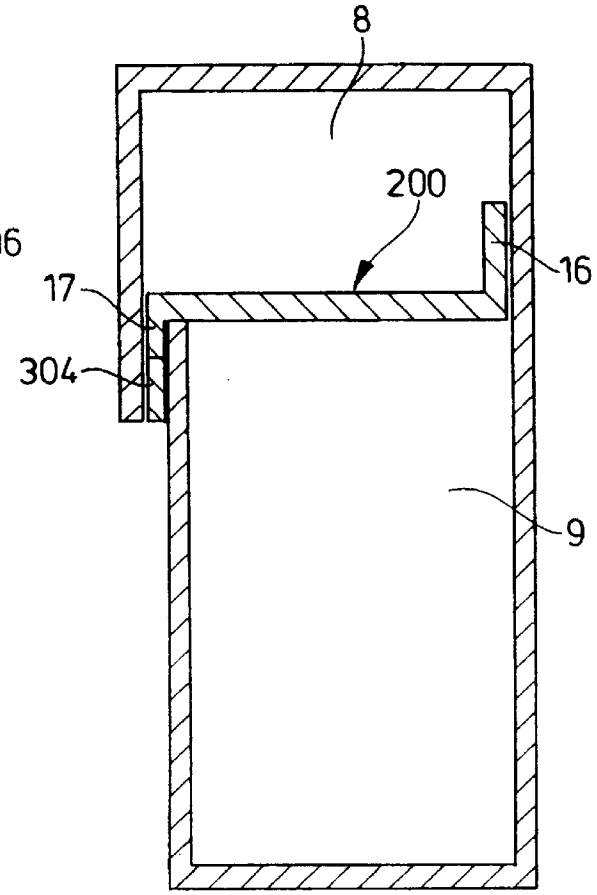
FIG. 24 is a cross-sectional view of the embodiment of a carton according to the invention made from the die-cut of FIGS. 9 and 11 along a plane parallel to the left side showing the wall construction of the carton.

A further embodiment of a die-cut for forming a carton according to the invention is illustrated on FIG. 14. This particular die-cut is in two parts and is combined with a one piece liner 5, the first part of the die cut being as on FIG. 9, the second part being the part 200 of FIG. 11. This embodiment also comprises a snap lock mechanism as described in FIGS. 9 to 13. Folding and gluing occurs as described in the sequence of FIGS. 15 and 16 to obtain the sleeve of FIG. 17.

Once a sleeve is obtained, the carton may be erected. An example of erection of a carton according to the invention is illustrated in FIGS. 18 to 21. In a first step the sleeve is unfolded to form a three dimensional structure, the optional fifth 31, third 33 and optional sixth 35 right flaps being folded as indicated by the arrows on FIG. 18, folding being provided on packing line by means of standard folding rails or tucker wheels. Thereafter, the carton takes a rectangular cross section, which is better maintained rectangular if a sixth right flap 35 is used, in order to reduce skewing. It should be noted that in this example, the folding of the right side is described, but the left side could be folded in an equivalent manner. Once folded, as in FIG. 19, glue is applied for example in a single operation as described on FIG. 19, whereby glue is applied on the second right flap 32 and on the first 30 and fourth 34 right flaps, before folding of the second right flap 32 as described in FIG. 20 and of the first 30 and fourth 34 right flaps as in FIG. 21. Thereafter, the right side of the carton is formed, so that the left side is the only side remaining opened. Once this is made, the carton may be turned around, the right side above, so as to be filled. However, this is not necessary because on most carton folding lines the folding can take place either from the above or under, so that the carton does not require being turned around during folding and filling. It should be noted that in the case of use of a carton according to the invention, the main 9 and the second 8 compartments can be filled, the main compartment 9 being preferably filled with granular materials such as detergent powder, while the second compartment 8 may be filled with a three dimensional object such as a tool kit or preferably a scooping device 7, for example. By a three dimensional object, it is meant that it is an object which has a total width, a total length and a total height which all are substantially larger than the thickness of the material from which the die-cut of the carton is made. The dimension of this object may determine at which level the extra panel 15 is placed in the carton. Once filling is achieved, the left side is folded, the folding of the left side normally comprising the same steps as the folding of the right side. This leads to a filled and closed carton structure, such as the structure presented in FIG. 29 or 30. It should be noted that this process allows use of standard machines, so that an other object of the invention is to produce a carton which is easy to process. Additionally, it is an object of the present invention to produce a carton at lower costs.

Figure 23:
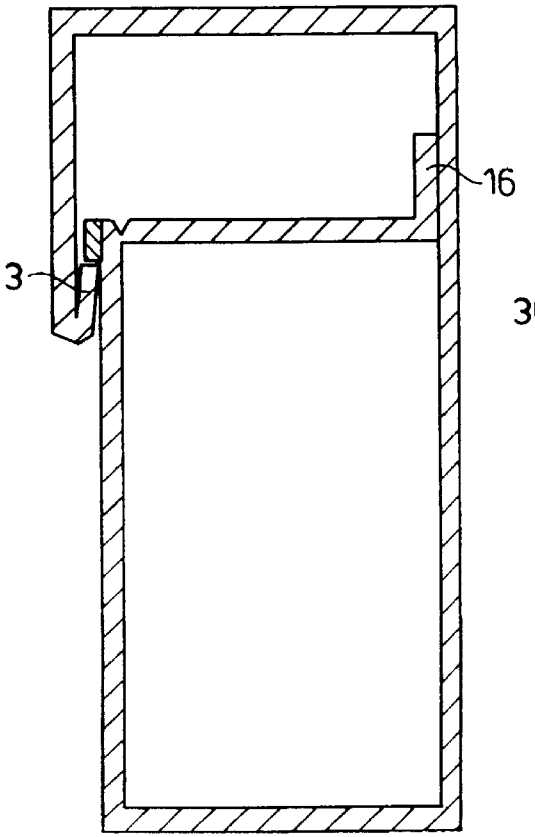
FIG. 23 is a cross-sectional view of the embodiment of a carton according to the invention made from the die-cut of FIG. 1 along a plane parallel to the left side showing the wall construction of the carton.
Figure 22:
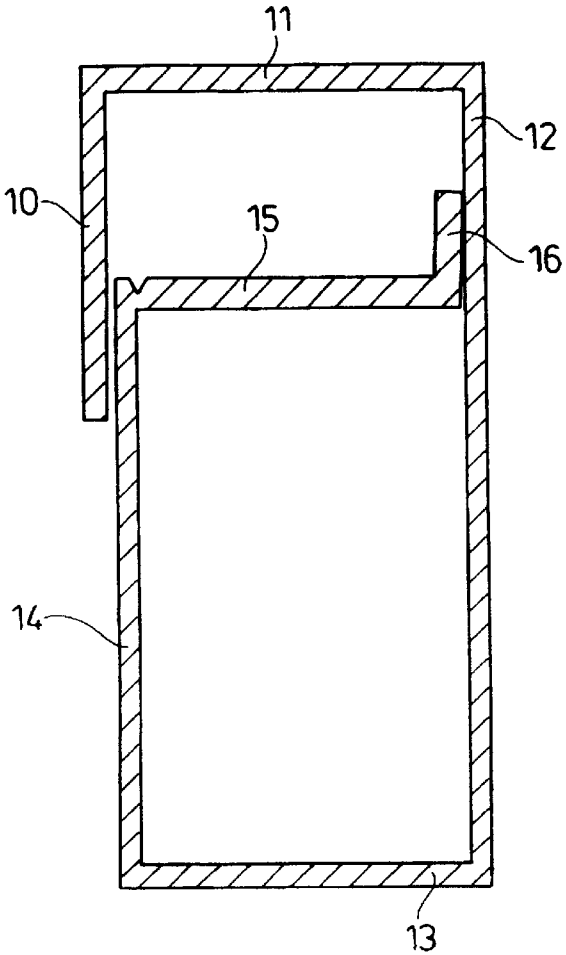
FIG. 22 is a cross-sectional view of an embodiment of a carton according to the invention along a plane parallel to the left side showing the wall construction of the carton.
Figure 25:
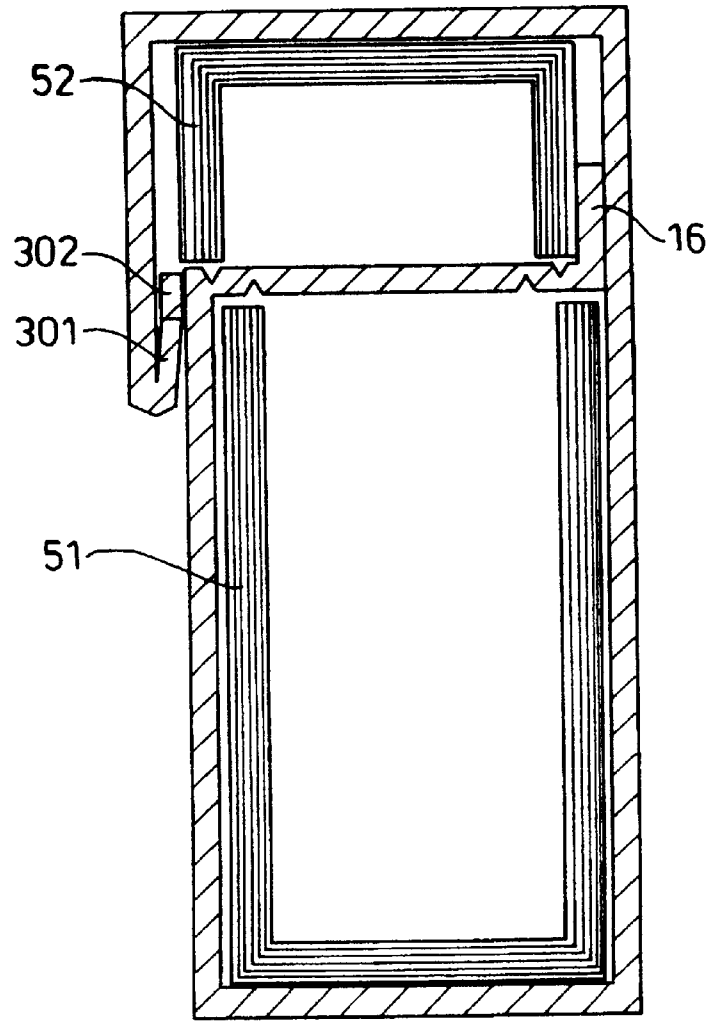
FIG. 25 is a cross-sectional view of the embodiment of a carton according to the invention made from the die-cut of FIGS. 5 and 6 along a plane parallel to the left side showing the wall construction of the carton.

FIG. 22 illustrates a cross section of a carton according to the invention in a plane parallel to the left or right sides and between these, the carton being made for example from the die-cut of FIG. 1 without the snap lock flaps. These are illustrated in FIG. 23. In these Figures as well as in the FIG. 28, the spring effect of the back flap 16 to tend to maintain the second compartment 8 in an opened position is illustrated. In FIG. 23, a carton made from the die cut of FIG. 9 which comprises two parts is illustrated. The following Figure, FIG. 25, illustrates a carton made from a one piece die-cut with a two parts liner 51, 52, as illustrated on FIGS. 5 to 8. In FIG. 26, the structure is further reinforced by extensions 53 of the liner.

Figure 27:
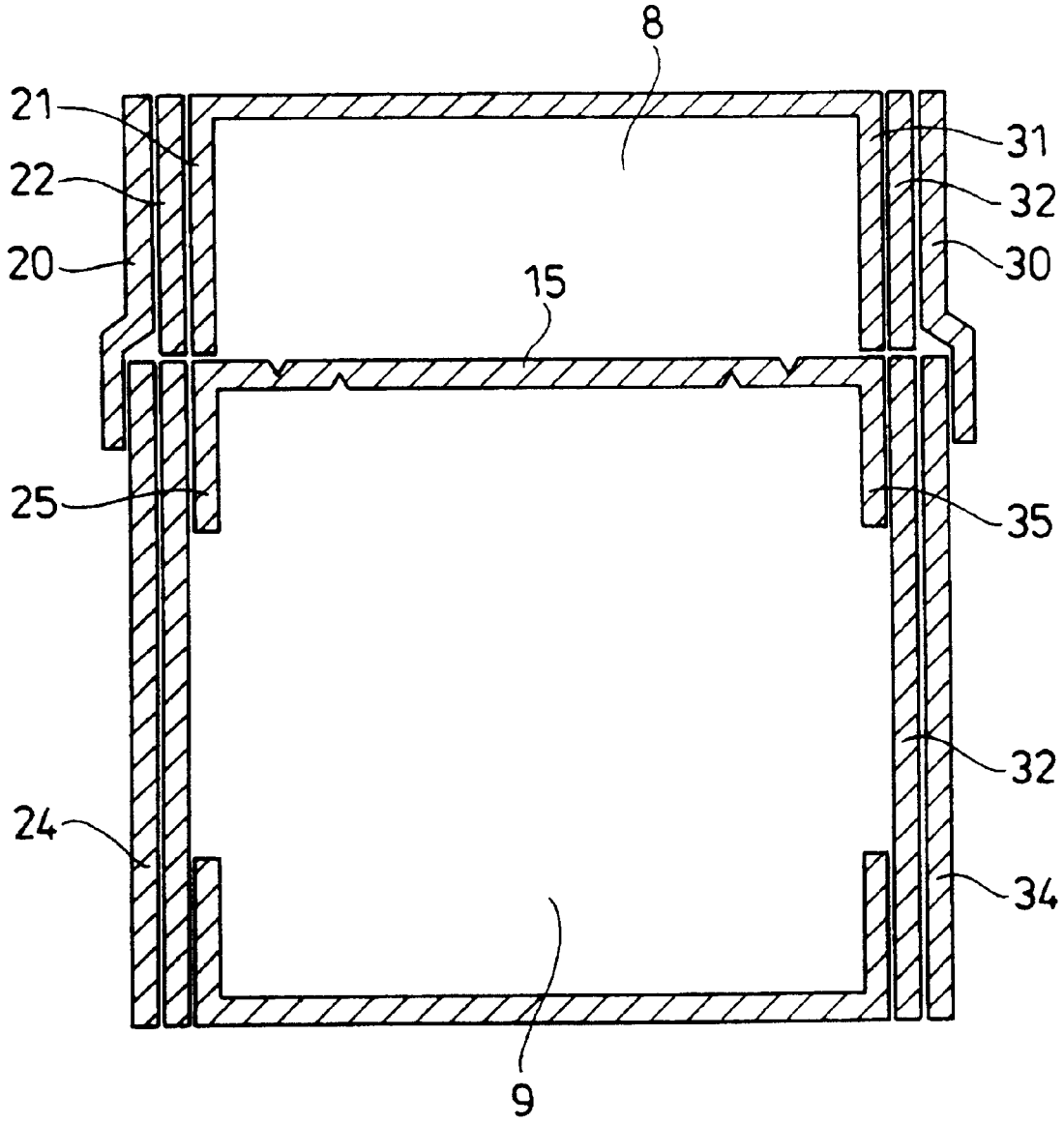
FIG. 27 is a cross-sectional view of an embodiment of a carton according to the invention along a plane parallel to the front side showing the wall construction of the carton.

FIG. 27 illustrates a cross section in a plane parallel to and between the front and back sides, whereby the extra panel 15 is provided with the optional sixth left 25 and right 35 flaps providing an improved sift-proof main compartment 9. It should also be noted that the first left 20 and right 30 flaps are folded over the optional fifth 21, 31 and second left 22 and right 32 flaps, and are also extending over the fourth left 24 and right 34 flaps in the same manner as the first front flap 10 may extend onto the second front flap 14 to facilitate re-closure of the carton. Furthermore, it should be noted that in another preferred embodiment, the optional fifth 21, 31 and second 22, 32 left and right flap can press onto the extra panel 15 to retain it closed after re-closing the carton. In the case illustrated, the optional fifth left 21 and right 31 flaps can participate to making the second compartments 8 sift proof.

Figure 30:
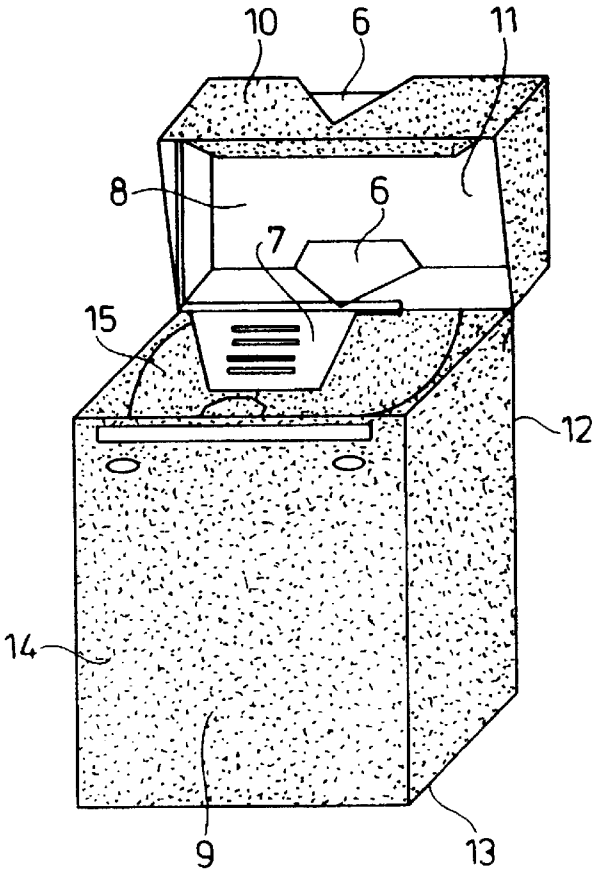
FIG. 30 is a perspective view of a further embodiment of a carton according to the invention after opening.
Figure 29:
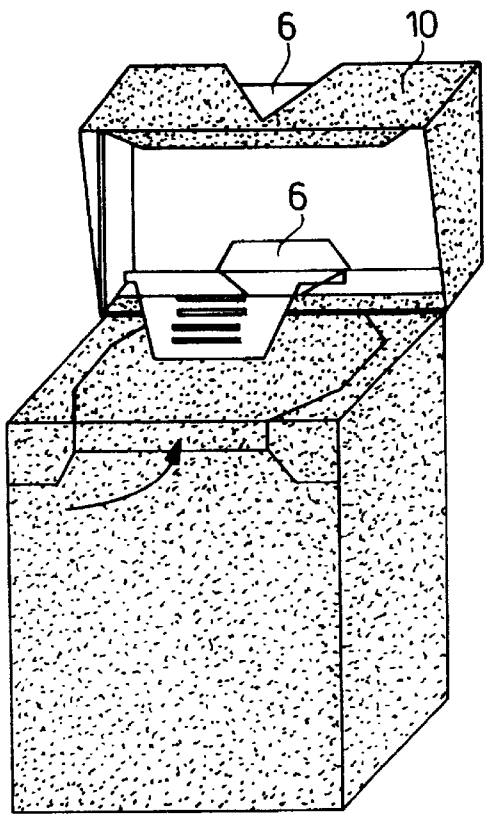
FIG. 29 is a perspective view of an embodiment of a carton according to the invention after opening.
Figure 28:
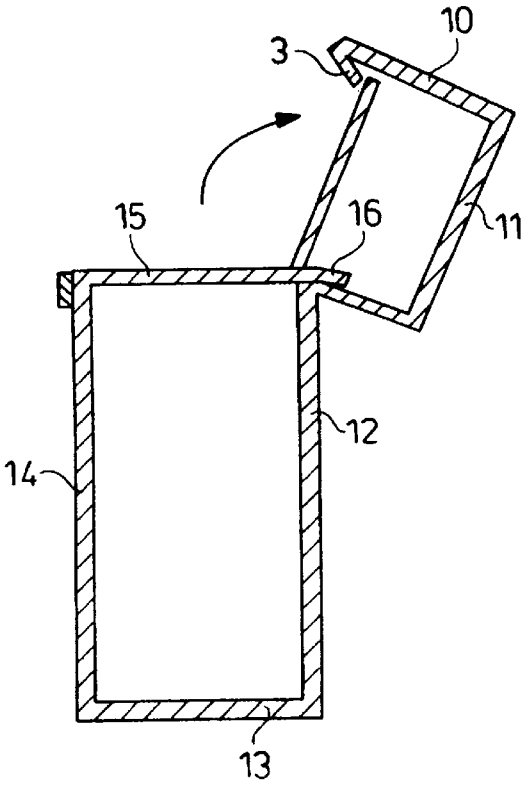
FIG. 28 is a cross-sectional view of a further embodiment of a carton according to the invention along a plane parallel to the left side showing the wall construction of the carton after opening.

Once the carton is formed, the user can easily access the content of the main compartment by opening or removing the extra panel 15 or part of it, from the position illustrated in FIG. 29 or 30 for example. Removal may be facilitated by various ways known in the art, using perforated lines, partial cuts, tear strip or tear tape, or by using easy release or easy peel glues around the edges for example. Preferably such weakness lines are slightly curved to avoid damage throughout the production and distribution chain. The extra panel may be only partially removable, in such a manner that part of the extra panel remains to avoid spillage of the content if, for example, the carton is inclined once opened. The removable part may be used to display instructions or as a promotional voucher or other items of the sort. In a preferred embodiment, the extra panel or part of it is hinged as illustrated in FIG. 28, so that it can be retained by the snap lock flap once the carton is opened, thus allowing full access to the main compartment. Upon re-closure, such a hinged part may be kept pressed down by the optional fifth and/or the part of the third left and right flaps comprised between the line of weakness and the top panel or by an indentation which may also serve as a means for opening, or by an extending flap of an inner liner for example. Such an indentation could be provided by a curvilinear line of weakness placed on the extra panel in the form of a semicircle 40 having its diameter corresponding to the edge between the extra panel and the second front flap, for example, so that a user may push it in to pull part of the extra panel away, while using it to maintain the same part upon re-closure. It should be noted that a hinged part of the extra panel could be defined by partial and reversed cuts, thus forming a shoulder or supporting edge to avoid that the extra panel is pushed in the main compartment too far, i.e. beyond its original position. In a preferred embodiment, the optional third front flap is glued at least partly to the first front flap so as to open the main compartment when opening the carton for the first time. It should also be noted that the snap lock feature is optional and may be replaced by a pre-cut de-lamination zone.

Opening may also be provided by the optional third front flap, whereby this optional third front flap 17 is linked with a folding line to the extra panel, and has a part which is removable and defined by one or more lines of weakness, as illustrated on FIG. 29. This may be combined with a snap lock flap as described in FIG. 29 similar to the snap lock described in the die-cut of FIGS. 9 to 13.

In a preferred embodiment of the invention, the die cut of the carton is provided with a transparent window, for example on the left, right or front side of the carton, whereby the user can evaluate the quantity of content remaining in the main compartment. Evaluation could be facilitated by providing graduation lines. Openings or cut outs in the second compartment could also provide windows allowing to visualise the content of this second compartment.

In a preferred embodiment, the carton is provided with openings 6 comprised in the front, back and top sides for forming a handle. Such openings 6 may be provided through the die-cut and the liner if such a liner is provided for reinforcing the second compartment. Such openings also allow the user to visualise an object placed in the second compartment if there is such an object. This is particularly suited for packing granules such as detergent powders, whereby such powders may be kept in a sift-proof manner in the main compartment, while a tool kit such as a scooping device is provided in the second compartment, thus reducing the messiness which would be induced by the extraction of such a three dimensional 7 object directly from the content of the main compartment. Such an object may simply be glued within the second compartment, for example with a single glue spot, to prevent movement of the object, or locked with locking tongues formed for example by cut outs of the openings providing a handle. Furthermore, placing such an object in the second compartment is a tamper proof location, as a user would have to open the carton to take the object.

What is claimed is:

1. A carton, the carton comprising:

top and bottom sides opposing each other;

left and right sides opposing each other; and front and back sides opposing each other, wherein said front side comprises a first front flap, said top side comprises a top panel associated with an edge to said first front flap, said back side comprises a back panel associated with an edge to said top panel, said bottom side comprises a bottom panel associated with an edge to said back panel, said front side comprises a second front flap associated with an edge to said bottom panel, wherein said carton comprises an extra panel situated between said top and said bottom panels, said extra panel being associated with an edge to said second front flap, said back side comprises a back flap associated with an edge to said extra panel, said left side comprises a first left flap associated with an edge to said first front flap a second left flap associated with an edge to said back panel, a third left flap associated with an edge to said bottom panel and a fourth left flap associated with an edge to said second front flap said right side comprises a first right flap associated with an edge to said first front flap, a second right flap associated with an edge to said back panel, a third right flap associated with an edge to said bottom panel and a fourth right flap associated with an edge to said second front flap and wherein said back panel comprises a folding line along a direction parallel to the plane of said top panel and situated between said extra and said top panels, each of said second left and right flaps comprise a line of weakness situated between said extra and top panels.

2. The carton according to claim 1, wherein said extra panel is in a plane parallel to the top panel.

3. The carton according to claim 1 wherein said left side further comprises a fifth left flap associated with an edge to said top panel, said right side further comprising a fifth right flap associated with an edge to said top panel.

4. The carton according to claim 1 wherein said first left flap covers at least partially said second and said fourth left flaps, and wherein said first right flap covers at least partially said second and said fourth right flap.

5. The carton according to claim 1 wherein said carton further comprises a snap lock mechanism attached to said first front flap.

6. The carton according to claim 1 wherein said extra panel comprises means for opening said extra panel.

7. The carton according to claim 1 wherein said carton further comprises a third front flap associated with an edge to said extra panel.

8. The carton according to claim 1 wherein said left side comprises a sixth left flap associated to said extra panel with an edge and wherein said right side comprises a sixth right flap associated to said extra panel with an edge.

9. The carton according to claim 1 wherein said carton further comprises an inner liner.

10. The carton according to claim 1 wherein said front and back side as well as the top side comprise openings for forming a handle.

11. The carton according to claim 1 wherein a three dimensional object is contained in the volume between said top and said extra panels.

12. The carton according to claim 6 wherein said means for opening said extra panel is selected from the group consisting of partial cuts, reversed cuts, perforations, tear tapes or any combination thereof.

13. The carton according to claim 7 wherein said extra panel, the third front flap and the back flap are formed from a separate piece of die cut.

14. The carton according to claim 1 wherein a granular material is contained in the volume between said bottom and top panels.

15. A carton, the carton comprising:

top and bottom sides opposing each other;

left and right sides opposing each other; and front and back sides opposing each other, wherein said front side comprises a first front flap, said top side comprises a top panel associated with an edge to said first front flap, said back side comprises a back panel associated with an edge to said top panel, said bottom side comprises a bottom panel associated with an edge to said back panel, said front side comprises a second front flap associated with an edge to said bottom panel, wherein said carton comprises an extra panel situated between said top and said bottom panels, said extra panel being associated with an edge to said second front flap, said back side comprises a back flap associated with an edge to said extra panel, said left side comprises a first left flap associated with an edge to said first front flap a second left flap associated with an edge to said back panel, a third left flap associated with an edge to said bottom panel and a fourth left flap associated with an edge to said second front flap said right side comprises a first right flap associated with an edge to said first front flap, a second right flap associated with an edge to said back panel, a third right flap associated with an edge to said bottom panel and a fourth right flap associated with an edge to said second front flap and wherein said back panel comprises a folding line wherein the folding line is situated in the plane of said extra panel, each of said second left and right flaps comprise a line of weakness situated in the plane of said extra panel.

16. The carton according to claim 15, wherein said extra panel is in a plane parallel to the top panel.

17. The carton according to claim 15 wherein said left side further comprises a fifth left flap associated with an edge to said top panel, said right side further comprising a fifth right flap associated with an edge to said top panel.

18. The carton according to claim 15 wherein said first left flap covers at least partially said second and said fourth left flaps, and wherein said first right flap covers at least partially said second and said fourth right flap.

19. The carton according to claim 15 wherein said carton further comprises a snap lock mechanism attached to said first front flap.

20. The carton according to claim 15 wherein said extra panel comprises means for opening said extra panel.

21. The carton according to claim 15 wherein said carton further comprises a third front flap associated with an edge to said extra panel.

22. The carton according to claim 15 wherein said left side comprises a sixth left flap associated to said extra panel with an edge and wherein said right side comprises a sixth right flap associated to said extra panel with an edge.

23. The carton according to claim 15 wherein said carton further comprises an inner liner.

24. The carton according to claim 15 wherein said front and back side as well as the top side comprise openings for forming a handle.

25. The carton according to claim 15 wherein a three dimensional object is contained in the volume between the top and the extra panels.

26. The carton according to claim 20 wherein said means for opening said extra panel is selected from the group consisting essentially of partial cuts, reversed cuts, perforations, tear tapes or a combination thereof.

27. The carton according to claim 26 wherein said extra panel, said third front flap and said back flap are formed from a separate piece of die cut.

28. The carton according to claim 15 wherein a granular material is contained in the volume between said bottom and top panels.

* * * * *